US008237636B2

(12) United States Patent
Oota et al.

(10) Patent No.: US 8,237,636 B2
(45) Date of Patent: Aug. 7, 2012

(54) METHOD OF MANUFACTURING DISPLAY AND METHOD OF ADJUSTING COLOR BALANCE

(75) Inventors: Masuyuki Oota, Hakusan (JP); Fumihiro Matsumoto, Tokorozawa (JP)

(73) Assignee: Japan Display Central Inc., Fukaya-shi (JP)

( * ) Notice: Subject to any disclaimer, the term of this patent is extended or adjusted under 35 U.S.C. 154(b) by 1055 days.

(21) Appl. No.: 12/173,292

(22) Filed: Jul. 15, 2008

(65) Prior Publication Data

US 2009/0021538 A1 Jan. 22, 2009

(30) Foreign Application Priority Data

Jul. 17, 2007 (JP) ..... 2007-186171

(51) Int. Cl.
*G09G 3/30* (2006.01)

(52) U.S. Cl. ..... 345/77; 313/504

(58) Field of Classification Search ..... 345/76–83; 315/169.3; 313/463, 504
See application file for complete search history.

(56) References Cited

U.S. PATENT DOCUMENTS 6,858,456 B2 * 2/2005 Noguchi et al. ..... 438/26
2004/0178973 A1 * 9/2004 Miller et al. ..... 345/82
2005/0134174 A1 * 6/2005 Shiratori et al. ..... 313/506
2006/0152468 A1 * 7/2006 Ozaki ..... 345/102
2007/0120496 A1 * 5/2007 Shimizu et al. ..... 315/169.3
2008/0030648 A1 * 2/2008 Morita et al. ..... 349/64

FOREIGN PATENT DOCUMENTS

JP 7-56545 3/1995
JP 2001-83552 3/2001
JP 2004-309509 11/2004
WO WO 03/091979 A1 11/2003

* cited by examiner

*Primary Examiner* — Jimmy H Nguyen
(74) *Attorney, Agent, or Firm* — Oblon, Spivak, McClelland, Maier & Neustadt, L.L.P.

(57) ABSTRACT

A method of adjusting color balance includes writing first to third adjustment video signals on first to third pixels, respectively to obtain first to third monochromatic data, updating the first to third adjustment video signals based on the first to third monochromatic data, writing the updated first to third adjustment video signals on the first to third pixels to obtain a mixed color data, updating the first to third adjustment video signals in the case where the mixed color data is within a tolerance and the power consumption exceeds a predetermined upper limit, and setting the first to third adjustment video signals updated finally as the maximum values of the video signals to be written on the first to third pixels, respectively.

10 Claims, 3 Drawing Sheets

METHOD OF MANUFACTURING DISPLAY AND METHOD OF ADJUSTING COLOR BALANCE

CROSS-REFERENCE TO RELATED APPLICATIONS

This application is based upon and claims the benefit of priority from prior Japanese Patent Application No. 2007-186171, filed Jul. 17, 2007, the entire contents of which are incorporated herein by reference.

BACKGROUND OF THE INVENTION

1. Field of the Invention

The present invention relates to a method of manufacturing a display and a method of adjusting color balance, in particular, a method of manufacturing an active-matrix display and a method of adjusting color balance thereof.

2. Description of the Related Art

In manufacture of active-matrix displays capable of displaying color images, adjustment of color balance is performed in some cases in order to achieve a desired white color. For example, JP-A 2001-83552 describes such an adjustment method.

As for manufacture of active-matrix displays including emitting elements as display elements such as organic electroluminescence (hereinafter referred to as "EL") elements, adjustment of color balance is performed, for example, by adjusting the maximum power for each emitting element. However, such displays are required to have power consumption equal to or lower than a specified value. For this reason, the adjustment of color balance takes a long time in many cases.

BRIEF SUMMARY OF THE INVENTION

An object of the present invention is to shorten the time period required for the adjustment of color balance in the manufacture of active-matrix displays including emitting elements as display elements.

According to a first aspect of the present invention, there is provided a method of manufacturing an active-matrix display comprising first to third pixels each including an emitting element and different in emitting color from one another, and first to third signal output circuits outputting video signals to the first to third pixels, respectively, comprising a first step including writing a first adjustment video signal on the first pixel to allow the first pixel emit light and, in this state, measuring luminance and chromaticity as first monochromatic color data, a second step including writing a second adjustment video signal on the second pixel to allow the second pixel emit light and, in this state, measuring luminance and chromaticity as second monochromatic color data, a third step including writing a third adjustment video signal on the third pixel to allow the third pixel emit light and, in this state, measuring luminance and chromaticity as third monochromatic color data, a fourth step including updating the first to third adjustment video signals based on the first to third data such that luminance and chromaticity will be predetermined target values when the updated first to third adjustment video signals are written on the first to third pixels, respectively to allow the first to third pixels to emit light simultaneously, a fifth step including writing the updated first to third adjustment video signal on the first to third pixel, respectively to allow the first to third pixels to emit light simultaneously, and in this state, measuring luminance and chromaticity as mixed color data, and a sixth step including, in a case where the mixed color data is within a predetermined tolerance and power consumption of the display or the first to third pixels at the measurement of the mixed color data exceeds a predetermined upper limit, updating the first to third adjustment video signals such that the power consumption will be equal to or lower than the upper limit, and the method including setting the first to third adjustment video signals updated finally as maximum values of the video signals to be written on the first to third pixels, respectively.

According to second first aspect of the present invention, there is provided a method of manufacturing an active-matrix display comprising first to third pixels each including an emitting element and different in emitting color from one another, a first digital-to-analog conversion circuit generating an analog video signal using a first digital video signal and a first reference current or voltage and outputting the analog video signal thus generated to the first pixel, a second digital-to-analog conversion circuit generating an analog video signal using a second digital video signal and a second reference current or voltage and outputting the analog video signal thus generated to the second pixel, a third digital-to-analog conversion circuit generating an analog video signal using a third digital video signal and a third reference current or voltage and outputting the analog video signal thus generated to the third pixel, a first power supply circuit outputting the first reference current or voltage to the first digital-to-analog conversion circuit, a second power supply circuit outputting the second reference current or voltage to the second digital-to-analog conversion circuit, and a third power supply circuit outputting the third reference current or voltage to the third digital-to-analog conversion circuit, comprising a first step including writing the analog video signal corresponding to a maximum value of the first digital video signal on the first pixel to allow the first pixel emit light and, in this state, measuring luminance and chromaticity as first monochromatic color data, a second step including writing the analog video signal corresponding to a maximum value of the second digital video signal on the second pixel to allow the second pixel emit light and, in this state, measuring luminance and chromaticity as second monochromatic color data, a third step including writing the analog video signal corresponding to a maximum value of the third digital video signal on the third pixel to allow the third pixel emit light and, in this state, measuring luminance and chromaticity as third monochromatic color data, a fourth step including updating the first to third reference currents or voltages based on the first to third data such that luminance and chromaticity will be predetermined target values when the analog video signal corresponding to the maximum value of the first digital video signal, the analog video signal corresponding to the maximum value of the second digital video signal, and the analog video signal corresponding to the maximum value of the third digital video signal are written on the first to third pixels, respectively to allow the first to third pixels to emit light simultaneously, a fifth step including, after updating the first to third reference currents or voltages, writing the analog video signal corresponding to the maximum value of the first digital video signal, the analog video signal corresponding to the maximum value of the second digital video signal, and the analog video signal corresponding to the maximum value of the third digital video signal are written on the first to third pixels, respectively to allow the first to third pixels to emit light simultaneously, and in this state, measuring luminance and chromaticity as mixed color data, and a sixth step including, in a case where the mixed color data is within a predetermined tolerance and power consumption of the display or the first to third pixels at the measurement of the mixed color data exceeds a predetermined upper limit, updating the first to third reference currents or voltages such that the power consumption will be equal to or lower than the upper limit.

According to a third aspect of the present invention, there is provided a method of adjusting color balance for an active-matrix display comprising first to third pixels each including an emitting element and different in emitting color from one another, and first to third signal output circuits outputting video signals to the first to third pixels, respectively, comprising a first step including writing a first adjustment video signal on the first pixel to allow the first pixel emit light and, in this state, measuring luminance and chromaticity as first monochromatic color data, a second step including writing a second adjustment video signal on the second pixel to allow the second pixel emit light and, in this state, measuring luminance and chromaticity as second monochromatic color data, a third step including writing a third adjustment video signal on the third pixel to allow the third pixel emit light and, in this state, measuring luminance and chromaticity as third monochromatic color data, a fourth step including updating the first to third adjustment video signals based on the first to third data such that luminance and chromaticity will be predetermined target values when the updated first to third adjustment video signals are written on the first to third pixels, respectively to allow the first to third pixels to emit light simultaneously, a fifth step including writing the updated first to third adjustment video signal on the first to third pixel, respectively to allow the first to third pixels to emit light simultaneously, and in this state, measuring luminance and chromaticity as mixed color data, and a sixth step including, in a case where the mixed color data is within a predetermined tolerance and power consumption of the display or the first to third pixels at the measurement of the mixed color data exceeds a predetermined upper limit, updating the first to third adjustment video signals such that the power consumption will be equal to or lower than the upper limit, and the method including setting the first to third adjustment video signals updated finally as maximum values of the video signals to be written on the first to third pixels, respectively.

According to a fourth aspect of the present invention, there is provided a method of adjusting color balance for an active-matrix display comprising first to third pixels each including an emitting element and different in emitting color from one another, a first digital-to-analog conversion circuit generating an analog video signal using a first digital video signal and a first reference current or voltage and outputting the analog video signal thus generated to the first pixel, a second digital-to-analog conversion circuit generating an analog video signal using a second digital video signal and a second reference current or voltage and outputting the analog video signal thus generated to the second pixel, a third digital-to-analog conversion circuit generating an analog video signal using a third digital video signal and a third reference current or voltage and outputting the analog video signal thus generated to the third pixel, a first power supply circuit outputting the first reference current or voltage to the first digital-to-analog conversion circuit, a second power supply circuit outputting the second reference current or voltage to the second digital-to-analog conversion circuit, and a third power supply circuit outputting the third reference current or voltage to the third digital-to-analog conversion circuit, comprising a first step including writing the analog video signal corresponding to a maximum value of the first digital video signal on the first pixel to allow the first pixel emit light and, in this state, measuring luminance and chromaticity as first monochromatic color data, a second step including writing the analog video signal corresponding to a maximum value of the second digital video signal on the second pixel to allow the second pixel emit light and, in this state, measuring luminance and chromaticity as second monochromatic color data, a third step including writing the analog video signal corresponding to a maximum value of the third digital video signal on the third pixel to allow the third pixel emit light and, in this state, measuring luminance and chromaticity as third monochromatic color data, a fourth step including updating the first to third reference currents or voltages based on the first to third data such that luminance and chromaticity will be predetermined target values when the analog video signal corresponding to the maximum value of the first digital video signal, the analog video signal corresponding to the maximum value of the second digital video signal, and the analog video signal corresponding to the maximum value of the third digital video signal are written on the first to third pixels, respectively to allow the first to third pixels to emit light simultaneously, a fifth step including, after updating the first to third reference currents or voltages, writing the analog video signal corresponding to the maximum value of the first digital video signal, the analog video signal corresponding to the maximum value of the second digital video signal, and the analog video signal corresponding to the maximum value of the third digital video signal are written on the first to third pixels, respectively to allow the first to third pixels to emit light simultaneously, and in this state, measuring luminance and chromaticity as mixed color data, and a sixth step including, in a case where the mixed color data is within a predetermined tolerance and power consumption of the display or the first to third pixels at the measurement of the mixed color data exceeds a predetermined upper limit, updating the first to third reference currents or voltages such that the power consumption will be equal to or lower than the upper limit.

DETAILED DESCRIPTION OF THE INVENTION

Figure 1:
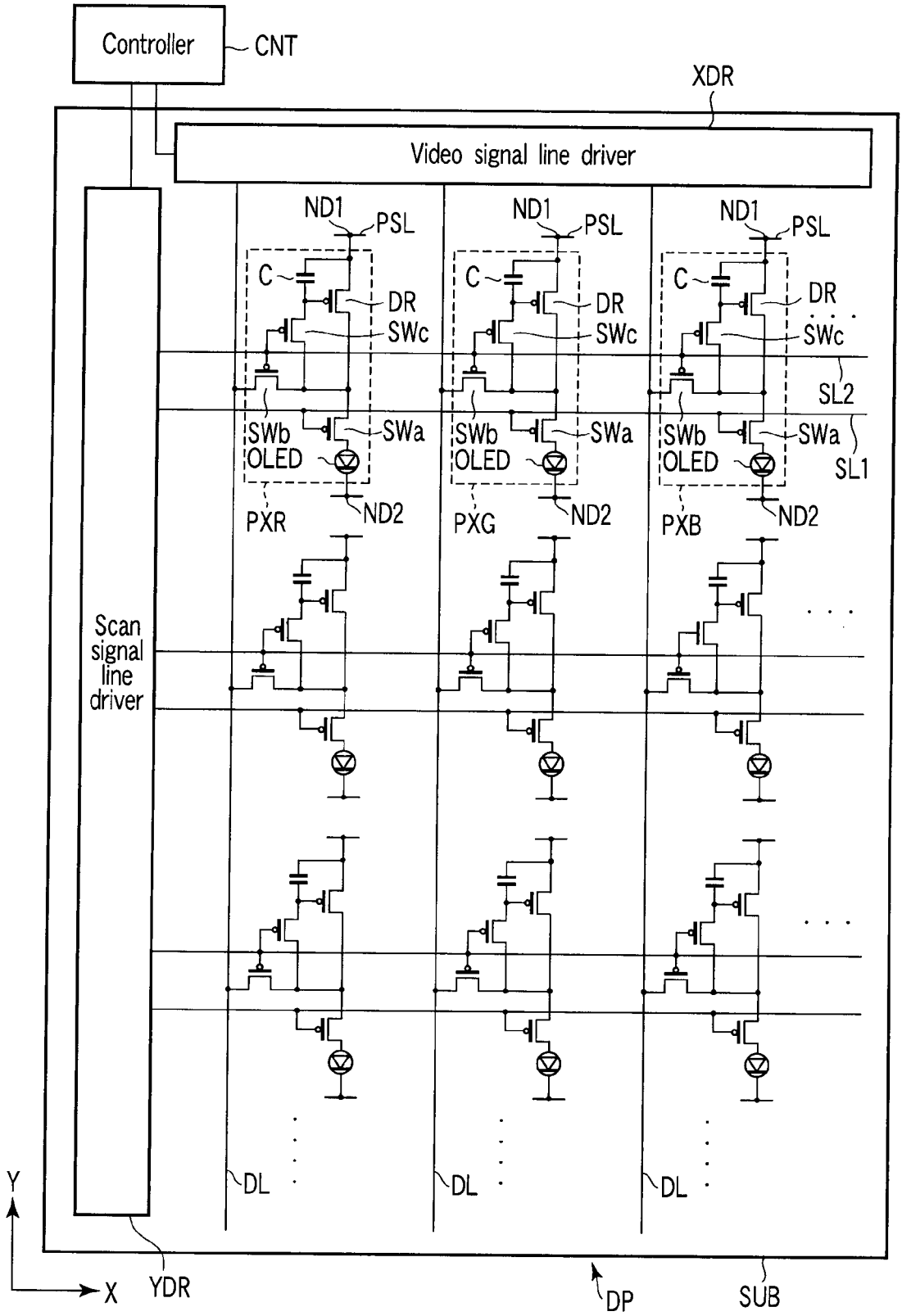
FIG. 1 is a plan view schematically showing an example of the display that can be manufactured by the method according to an embodiment of the present invention.

Embodiments of the present invention will be described in detail below with reference to the accompanying drawings. Note that the same reference numerals denote components that achieve the same or similar functions in the drawings, and repetitive explanation thereof will be omitted.

Figure 2:
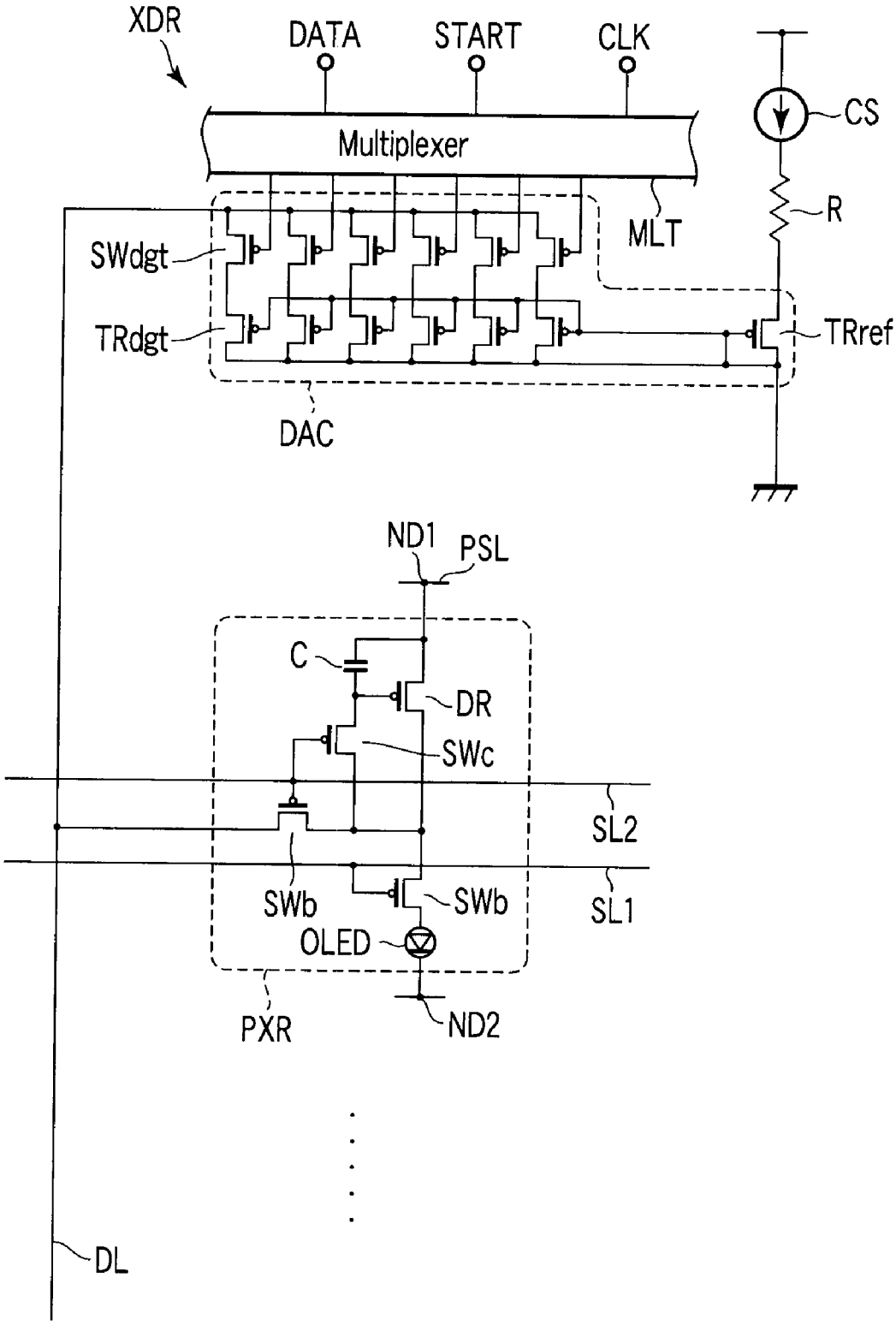
FIG. 2 is an equivalent circuit diagram showing a part of the display shown in FIG. 1.

FIG. 1 is a plan view schematically showing an example of the display that can be manufactured by the method according to an embodiment of the present invention. FIG. 2 is an equivalent circuit diagram showing a part of the display shown in FIG. 1.

The display shown in FIG. 1 is a bottom emission organic EL display employing an active matrix driving method. The display can display a color image and includes a display panel DP, a video signal line driver XDR, a scan signal line driver YDR, and a controller CNT.

The display panel DP includes, for example, an insulating substrate SUB such as glass substrate. On the substrate SUB, for example, an $SiN_x$ layer and an $SiO_x$ layer are stacked in this order as an undercoat layer.

Semiconductor layers such as polysilicon layers in each of which source and drain are formed, a gate insulator which may be formed by using tetraethyl orthosilicate (TEOS), and gates which are made of, for example, MoW are stacked in this order on the undercoat layer to form top gate-type thin-film transistors. In this embodiment, the thin-film transistors are p-channel thin-film transistors and utilized as drive control elements DR and switches SWa to SWc shown in FIGS. 1 and 2.

Bottom electrodes of capacitors C and scan signal lines SL1 and SL2 are further arranged on the gate insulator. These components can be formed in the same step as that for the gates.

As shown in FIG. 1, the scan signal lines SL1 and SL2 extend along the rows of the pixels PXR, PXG and PXB, i.e., in the X direction, and are alternately arranged along the columns of the pixels PXR, PXG and PXB, i.e., in the Y direction. The scan signal lines SL1 and SL2 are connected to the scan signal line driver YDR.

An interlayer insulating film covers the gate insulator, the gates, the scan signal lines SL1 and SL2, and the bottom electrodes of the capacitors C. The interlayer insulating film is, for example, an $SiO_x$ layer formed by plasma CVD. Parts of the interlayer insulating film are utilized as dielectric layers of the capacitors C.

On the interlayer insulating film, top electrodes of the capacitors C, source electrodes, drain electrodes, video signal lines DL and power supply lines PSL are arranged. These components can be formed in the same step and, for example, have a three-layer structure of Mo, Al and Mo.

The source electrodes and drain electrodes are electrically connected to sources and drains of the thin-film transistors via contact holes formed in the interlayer insulting film.

The video signal lines DL extend in the Y direction and are arranged in the X direction. The video signal lines DL are connected to the video signal line driver XDR.

The power supply lines PSL extend in the Y direction and are arranged in the X direction in the present embodiment. In this embodiment, the power supply lines PSL are connected to the video signal line driver XDR.

A passivation layer covers the source electrodes, drain electrodes, video signal lines DL, power supply lines PSL, and top electrodes of the capacitors C. The passivation layer is made of, for example, $SiN_x$.

Light-transmitting pixel electrodes as front electrodes are arranged on the passivation layer such that they are spaced apart from one another. Each of the pixel electrodes is connected through a through-hole formed in the passivation layer to the drain electrode to which the drain of the switch SWa is connected.

In this embodiment, the pixel electrodes are anodes. As a material of the pixel electrodes, for example, a transparent conductive oxide such as indium tin oxide (ITO) can be used.

An insulating partition layer is further placed on the passivation layer. The insulating partition layer has through-holes at the positions corresponding to the pixel electrodes, or alternatively, has slits at the positions corresponding to the columns or rows of the pixel electrodes. Here, by way of example, the insulating partition layer has through-holes at the positions corresponding to the pixel electrodes.

The insulating partition layer is, for example, an organic insulating layer. The insulating partition layer can be formed using, for example, a photolithography technique.

An organic layer that includes an emitting layer as an active layer is placed on each of the pixel electrodes. The emitting layer is, for example, a thin film containing a luminescent organic compound that emits red, green, or blue light. In addition to the emitting layer, the organic layer may further include a hole injection layer, a hole-transporting layer, a hole-blocking layer, an electron-transporting layer, an electron injection layer, etc.

The insulating partition layer and the organic layer are covered with a counter electrode placed to face the pixel electrodes. The counter electrode is a common electrode shared among the pixels PXR, PXG and PXB and is a light-reflecting cathode serving as a back electrode in this embodiment. For example, an electrode wire (not shown) is formed on the layer on which the video signal lines DL are formed, and the counter electrode is electrically connected to the electrode wire via a contact hole formed in the passivation layer and insulating partition layer. Each organic EL element OLED is composed of the pixel electrode, the organic layer and the counter electrode.

Pixels PXR, PXG and PXB are arranged in a matrix on the insulating substrate SUB. In the present embodiment, triplets each composed of three pixels PXR, PXG and PXB arranged in the X direction are arranged in the X and Y directions.

Each of the pixels PXR, PXG and PXB includes a drive circuit and the organic EL element OLED connected in series between the power supply terminals ND1 and ND2. In this embodiment, the drive circuit includes a drive control element DR, a capacitor C, an output control switch SWa, a signal supply control switch SWb, and a diode-connecting switch SWc. As described above, in this embodiment, the drive control element DR and switches SWa to SWc are p-channel thin-film transistors. The switches SWb and SWc form a switch group that switches between a first state in which the drain and gate of the drive control element DR and the video signal line DL are connected to one another and a second state in which they are disconnected from one another.

The drive control element DR, the output control switch SWa, and the organic EL element OLED are connected in series between the first power supply terminal ND1 and the second power supply terminal ND2 in this order. In this embodiment, the first power supply terminal ND1 is a high-potential power supply terminal connected to the power supply line PSL, while the second power supply terminal ND2 is a low-potential power supply terminal to be set at a potential lower than that of the first power supply terminal ND1.

A gate of the switch SWa is connected to the scan signal line SL1. The signal supply control switch SWb is connected between the video signal line DL and the drain of the drive control element DR. The gate of the signal supply control switch SWb is connected to the scan signal line SL2. The diode-connecting switch SWc is connected between the drain and gate of the drive control element DR. The gate of the diode-connecting switch SWc is connected to the scan signal line SL2.

The capacitor C is connected between a constant-potential terminal and the gate of the drive control element DR. In this embodiment, the capacitor C is connected between the first power supply terminal ND1 and the gate of the drive control element DR.

The video signal line driver XDR is mounted on the display panel DP. The video signal line driver XDR includes first to third power supply circuits correspondingly with three emission colors, and further includes reference transistors $TR_{ref}$ correspondingly with the power supply circuits. In addition, the video signal line driver XDR further includes a multiplexer MLT and plural sets of a transistor $TR_{dgt}$ and a switch $SW_{dgt}$ for every video signal line DL. Although only the structure corresponding to the emission color of red is depicted in FIG. 2, the structures corresponding to the emission colors of green and blue are equal to this.

Each of the power supply circuit includes a current source CS and a resistance element R. The current source CS outputs a preset reference current $I_{ref}$ during a period when driving the display. The current source CS, the resistance element R and the reference transistor $TR_{ref}$ are connected in series between a pair of power supply terminal.

The reference transistor $TR_{ref}$ is a p-channel field-effect transistor in this embodiment. The reference transistor $TR_{ref}$ includes a source connected via the resistance element R to the output terminal of the current source CS, a drain connected to a ground wire, and a gate connected to the drain.

The transistor $TR_{dgt}$ and the switch $SW_{dgt}$ of each set are connected in series between the output terminal of the video signal line driver XDR and the ground wire. In this embodiment, the transistor $TR_{dgt}$ and the switch $SW_{dgt}$ are p-channel field-effect transistors. Also, in this embodiment, the video signal line driver XDR includes six transistors $TR_{dgt}$ and the six switches $SW_{dgt}$ for every video signal line DL. The transistors $TR_{dgt}$, the switches $SW_{dgt}$ and the reference transistor $TR_{ref}$ constitute a digital-to-analog converting circuit DAC.

The gates of the transistors $TR_{dgt}$ are connected to the gate of the reference transistor $TR_{ref}$. The gates of the switches $SW_{dgt}$ are connected to the output terminals of the multiplexer MLT, respectively.

For example, one of the transistors $TR_{dgt}$ has the same structure as that of the reference transistor $TR_{ref}$, and the remaining five have the same structure as that of the reference transistor $TR_{ref}$ except for channel width. The six transistors $TR_{dgt}$ output constant-currents having magnitudes one time, two times, four times, eight times, sixteen times, and thirty two times the magnitude of the reference current $I_{ref}$, respectively, during the period when the switches $SW_{dgt}$ connected thereto are closed.

The multiplexer MLT includes input terminals to which a clock signal CLK, a start signal START, a video signal DATA as a serial signal are supplied. The multiplexer MLT further includes plural output terminals for every video signal line DL. The multiplexer MLT converts the video signal DATA from a serial signal into parallel signals and outputs them under the control of the clock signal CLK and the start signal START. In this embodiment, the multiplexer MLT outputs the video signal as a 6-bit digital signal.

The scan signal line driver YDR is further mounted on the display panel DP. As described above, the scan signal lines SL1 and SL2 are connected to the scan signal line driver YDR. The control signals such as start signal and the clock signal control the operation of the scan signal line driver YDR. The outputs first and second scan signals to the scan signal lines SL1 and SL2, respectively, under the control of the control signals.

The video signal line driver XDR and the scan signal line driver YDR are connected to the controller CNT. The controller outputs the control signals such as start signal and clock signal to the scan signal line driver YDR, and outputs the control signals such as clock signal CLK and start signal START and the video signal DATA to the video signal line driver XDR. In addition, the controller CNT further outputs the control signal that controls the magnitude of the reference current $I_{ref}$ output by each current source CS to the video signal line driver XDR.

When driving the display, an effective scanning period and a blanking period are repeated alternately. During each effective scanning period, the pixels PXR, PXG and PXB are sequentially selected on a line-by-line basis. During a selection period that the pixels PXR, PXG and PXB are selected, a write operation is executed on each of the particular pixels PXR, PXG and PXB. On the other hand, during a non-selection period that the pixels PXR, PXG and PXB are not selected an effective display operation is executed on each of the particular pixels PXR, PXG and PXB.

For example, during a period that the pixels PXR, PXG and PXB in a m-th row are selected (to be referred to as m-th row selection period), the switches SWa of the pixels PXR, PXG and PXB in the m-th row are opened. Then, the multiplexer MLT outputs 6 bit digital video signals to the digital-to-analog converting circuits DAC, and the switches SWb and SWc of the pixels PXR, PXG and PXB in the m-th row are closed. Note that during the effective scanning period, the reference currents $I_{ref}$ are kept flowing through the reference transistors $TR_{ref}$.

Each digital-to-analog converting circuit DAC converts the digital video signal into a write current $I_{sig}m$ as an analog video signal. The write current $I_{sig}m$ flows from the first power supply terminal ND1 to the digital-to-analog converting circuit DAC. As a result, in each of the pixels PXR, PXG and PXB in the m-th row, the gate potential of the drive control element DR is set at a value when the write current $I_{sig}m$ flows between the source and drain of the drive control element DR.

Thereafter the switches SWb and SWc of the pixels PXR, PXG and PXB in the m-th row are opened. Then, the switches SWa of the pixels PXR, PXG and PXB in the m-th row are closed to complete the m-th row selection period.

When the switches SWa are closed, drive currents $I_{drv}m$ whose magnitude correspond to the magnitude of the write currents $I_{sig}m$ flow through the organic EL elements OLED. During the non-selection period, the switches SWa are kept closed. Therefore, the organic EL elements OLED of the pixels PXR, PXG and PXB continue light-emission at luminance corresponding to the magnitude of the drive currents $I_{drv}m$ until the pixels are selected again.

After finishing the m-th row selection period, the m+1-th row selection period is started. During the m+1-th row selection period, the above-described write operations are executed on the pixels PXR, PXG and PXB in the m+1-th row. As above, the write operations are sequentially executed on the pixels PXR, PXG and PXB in the 1st to m-th rows on a line-by-line basis.

The display can be manufactured, for example, by the following method.

First, the display described with reference to FIGS. 1 and 2 is obtained. Then, color balance of the display is adjusted by the method shown in FIG. 3.

Figure 3:
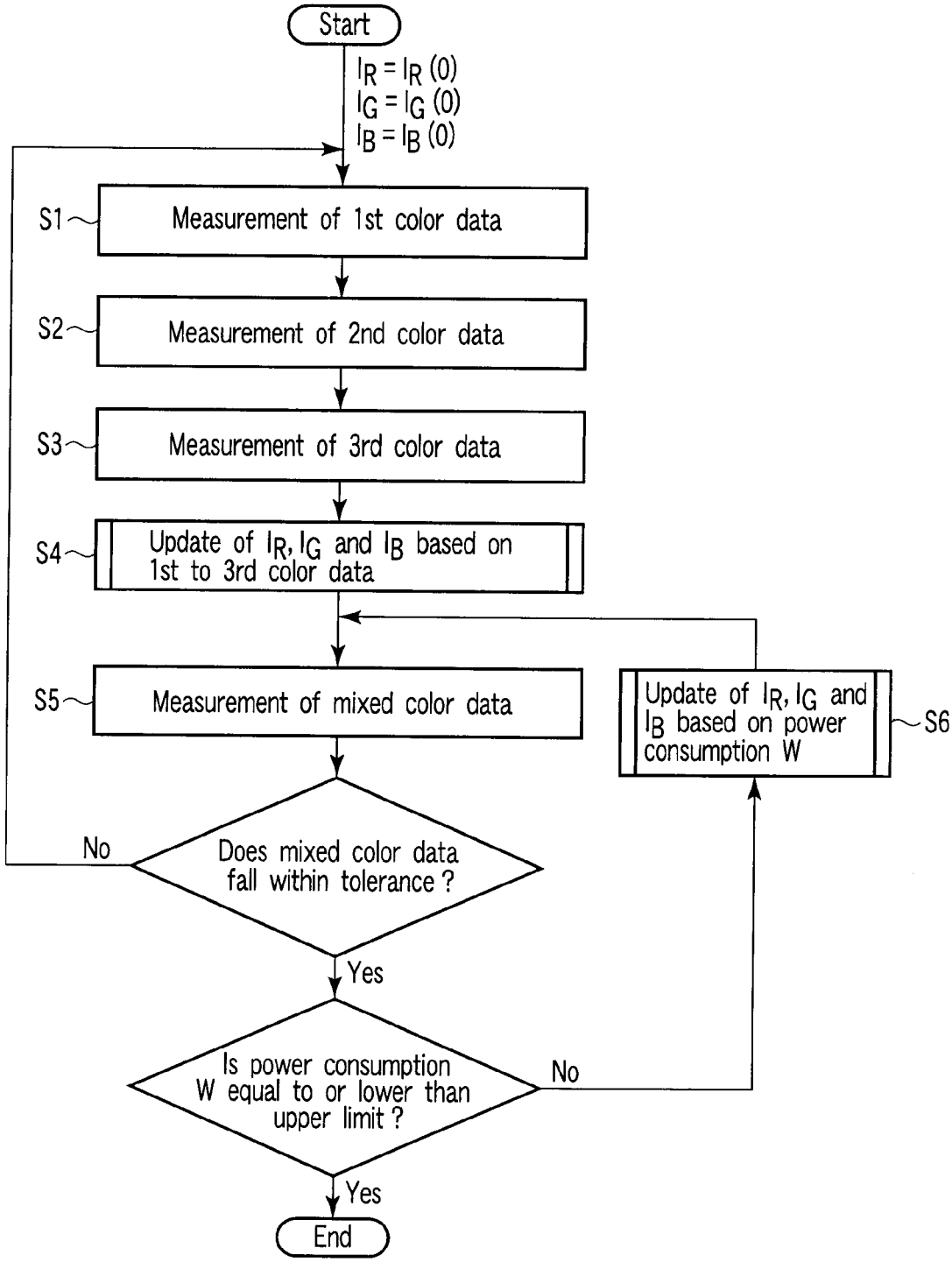
FIG. 3 is a flow chart showing a method of adjusting color balance according to an embodiment of the present invention.

FIG. 3 is a flow chart showing a method of adjusting color balance according to an embodiment of the present invention. In FIG. 3, the reference symbol $I_R$, $I_G$ and $I_B$ represent the reference currents $I_{ref}$ utilized for generating analog video signals to be supplied to the pixels PXR, PXG and PXB, respectively.

According to the method, first, the reference currents $I_R$, $I_G$ and $I_B$ are set at initial values $I_R(0)$, $I_G(0)$ and $I_B(0)$, respectively. Although the initial values $I_R(0)$, $I_G(0)$ and $I_B(0)$ can have any magnitudes, typically, they are set to have magnitudes predicted to be almost equal to those of the reference currents $I_R$, $I_G$ and $I_B$ to be set finally.

Next, the first step S1, the second step S2 and the third step S3 are executed. There is no limit to the order of the steps S1 to S3. Here, as an example, it is assumed that the steps S1 to S3 are executed in this order.

In the step S1, only the organic EL elements OLED of the pixels PXR are allowed to emit light, and luminance and chromaticity for red color are measured as the first monochromatic color data. Specifically, an analog video signal corresponding to the maximum value of the digital video signal that the multiplexer MLT outputs is written as the first adjustment video signal on each of the pixels PXR, while writing an analog video signal corresponding to the minimum value of the digital video signal that the multiplexer MLT outputs on each of the pixels PXG and PXB. Here, the reference current $I_R$ is kept at the initial value $I_R(0)$. Thus, only the organic EL elements OLED of the pixels PXR are allowed to emit light, and the luminance and chromaticity of a red-colored raster image are measured as the first monochromatic color data.

In the step S2, only the organic EL elements OLED of the pixels PXG are allowed to emit light, and luminance and chromaticity for green color are measured as the second monochromatic color data. Specifically, an analog video signal corresponding to the maximum value of the digital video signal that the multiplexer MLT outputs is written as the second adjustment video signal on each of the pixels PXG, while writing an analog video signal corresponding to the minimum value of the digital video signal that the multiplexer MLT outputs on each of the pixels PXB and PXR. Here, the reference current $I_G$ is kept at the initial value $I_G(0)$. Thus, only the organic EL elements OLED of the pixels PXG are allowed to emit light, and the luminance and chromaticity of a green-colored raster image are measured as the second monochromatic color data.

In the step S3, only the organic EL elements OLED of the pixels PXB are allowed to emit light, and luminance and chromaticity for blue color are measured as the third monochromatic color data. Specifically, an analog video signal corresponding to the maximum value of the digital video signal that the multiplexer MLT outputs is written as the third adjustment video signal on each of the pixels PXB, while writing an analog video signal corresponding to the minimum value of the digital video signal that the multiplexer MLT outputs on each of the pixels PXR and PXG. Here, the reference current $I_B$ is kept at the initial value $I_B(0)$. Thus, only the organic EL elements OLED of the pixels PXB are allowed to emit light, and the luminance and chromaticity of a blue-colored raster image are measured as the third monochromatic color data.

Then, the step S4 is executed. In the step S4, the reference currents $I_R$, $I_G$ and $I_B$ are updated based on the results of the measurements in the steps S1 to S3, i.e., the first to third monochromatic color data. Specifically, it is supposed that all the organic EL elements OLED of the pixels PXR, PXG and PXB are allowed to emit light so as to display a predetermined white image (hereinafter, referred to as "target white image"). Then, the reference currents $I_R$, $I_G$ and $I_B$ are updated based on the results of the measurements in the steps S1 to S3 such that a white image displayed when the analog video signals corresponding to the maximum values of the digital video signals are supplied to the pixels PXR, PXG and PXB will have luminance and chromaticity equal to the luminance and the chromaticity of the above-described target white image, i.e., predetermined target values for luminance and chromaticity. To update the reference currents $I_R$, $I_G$ and $I_B$, for example, the algorithm represented by the following equations (1) to (14) can be utilized.

$$\alpha = y_R \times y_G \tag{1}$$

$$\beta = y_G \times y_B \tag{2}$$

$$\gamma = y_B \times y_R \tag{3}$$

$$\sigma = y_R \times y_G \times y_B \tag{4}$$

-continued $$A = x_W(IV) \times \beta - x_W(IV) \times \alpha + x_B \times \alpha - x_R \times \beta \tag{5}$$

$$B = [x_W(IV) \times \gamma - x_W(IV) \times \alpha + x_B \times \alpha - x_G \times \gamma] \times \frac{\alpha - \beta}{\gamma - \alpha} \tag{6}$$

$$C = x_B \times \alpha - x_W(IV) \times \alpha \tag{7}$$

$$D = \frac{[y_W(IV) \times \alpha - \beta] \times [x_W(IV) \times \gamma - x_W(IV) \times \alpha + x_B \times \alpha - x_G \times \gamma]}{y_W(IV) \times (\gamma - \alpha)} \tag{8}$$

$$Y_R(TV) = \frac{(C + D) \times Y_W(IV)}{A + B} \tag{9}$$

$$Y_G(TV) = \frac{[\sigma - y_W(IV) \times \alpha] \times Y_W(IV) + y_W(IV) \times (\alpha - \beta) \times Y_R(IV)}{y_W(IV) \times (\gamma - \alpha)} \tag{10}$$

$$Y_B(TV) = Y_W(IV) - Y_R(IV) - Y_G(IV) \tag{11}$$

$$I'_R = \frac{Y_R(TV)}{Y_R} \times I_R \tag{12}$$

$$I'_G = \frac{Y_G(TV)}{Y_G} \times I_G \tag{13}$$

$$I'_B = \frac{Y_B(TV)}{Y_B} \times I_B \tag{14}$$

In the equations, $Y_R$, $Y_G$ and $Y_B$ represent the values Y of the tristimulus value in the CIE calorimetric system obtained for the red, green and blue-colored raster images, respectively. Also, $x_R$, $x_G$ and $x_B$ represent the values x of the chromaticity coordinates (x, y) obtained for the red, green and blue-colored raster images, respectively, while $y_R$, $y_G$ and $y_B$ represent the values y of the chromaticity coordinates (x, y) obtained for the red, green and blue-colored raster images, respectively. $Y_W(IV)$ represents the value Y of the tristimulus value in the CIE calorimetric system for the target white image, while $x_W(IV)$ and $y_W(IV)$ represent the values x and y of the chromaticity coordinates (x, y) for the target white image, respectively. Further, in the equations (12) to (14), $I_R$, $I_G$ and $I_B$ in the right-hand side represent the reference current $I_R$, $I_G$ and $I_B$ before the updating, respectively, while $I_R'$, $I_G'$ and $I_B'$ in the left-hand side represent the reference current $I_R$, $I_G$ and $I_B$ after the updating, respectively.

The first to third adjustment video signals change according to the magnitudes of the reference currents $I_R$, $I_G$ and $I_B$, respectively. Thus, when the reference currents $I_R$, $I_G$ and $I_B$ are updated into the currents $I_R'$, $I_G'$ and $I_B'$, respectively, the first to third adjustment video signals are also updated.

Next, the fifth step S5 is executed. In the step S5, the updated first to third adjustment video signals are written on the pixels PXR, PXG and PXB, respectively. Specifically, an analog video signal corresponding to the maximum value of the digital video signal that the multiplexer MLT outputs is written on each of the pixels PXR, PXG and PXB. Here, the reference currents are kept at the updated values $I_R'$, $I_G'$ and $I_B'$, respectively. Thus, all the organic EL elements of the pixels PXR, PXG and PXB are allowed to emit light, and luminance and chromaticity of a white-colored image are measured as mixed color data. In addition, the power consumption of the display or the pixels PXR, PXG and PXB are measured when the white-colored image is displayed.

In the case where the mixed color data is within a predetermined tolerance and the power consumption W is also within a predetermined tolerance, the adjustment of color balance is terminated. In the case where the mixed color data is out of tolerance, the first sequence of the steps S1 to S5 is executed again. Note that in many cases, the tolerance for the power consumption W is defined only by the upper limit W(UL), and no lower limit is set.

In the case where the mixed color data is within tolerance and the power consumption W is out of tolerance, the sixth step S6 is executed. In the sixth step S6, the reference currents $I_R$, $I_G$ and $I_B$ are updated such that the power consumption W will be equal to or lower than the upper limit W(UL). To update the reference currents $I_R$, $I_G$ and $I_B$, for example, the algorithm represented by the following equations (15) to (17) can be utilized.

$$I_R'' = \frac{W(IV)}{W} \times I_R \tag{15}$$

$$I_G'' = \frac{W(IV)}{W} \times I_G \tag{16}$$

$$I_B'' = \frac{W(IV)}{W} \times I_B \tag{17}$$

In the equations, W(IV) represents a power consumption lower than the upper limit W(UL), which is hereinafter referred to as "target power consumption". Also, in the equations (15) to (17), $I_R$, $I_G$ and $I_B$ in the right-hand side represent the reference currents $I_R$, $I_G$ and $I_B$ before the updating, respectively, while $I_R''$, $I_G''$ and $I_B''$ in the left-hand side represent the reference currents $I_R$, $I_G$ and $I_B$ after the updating, respectively.

After the updating in the step S6, the step S5 is executed. When luminance and chromaticity of a white-colored image displayed in the step S5 is within tolerance and the power consumption W is also within tolerance, the adjustment of color balance is terminated.

In the case where the luminance and chromaticity of the white-colored image displayed in the step S5 is within tolerance and the power consumption W is out of tolerance, the sixth step S6 is executed again. Then, the step S5 is executed. In the case where the luminance and chromaticity of the white-colored image displayed in the step S5 is within tolerance and the power consumption W is also within tolerance, the adjustment of color balance is terminated. In the case where the luminance and chromaticity of the white-colored image displayed in the step S5 is within tolerance and the power consumption W is out of tolerance, the second sequence of the steps S6 and S5 is executed again. As long as the luminance and chromaticity of the white-colored image displayed in the step S5 are within tolerance, the second sequence of the steps S6 and S5 is repeated until the power consumption falls within tolerance.

In the case where the luminance and chromaticity of the white-colored image displayed in the step S5 are out of tolerance, the first sequence of the steps S1 to S5 is executed again. The first sequence is repeated until the luminance and chromaticity of the white-colored image displayed in the step S5 fall within tolerance. In the case where the luminance and chromaticity of the white-colored image displayed in the step S5 fall within tolerance, the adjustment of color balance is terminated if the power consumption W also falls within tolerance, whereas the second sequence of the step S6 and S5 is executed again if the power consumption is out of tolerance.

Note that at each moment of starting the first sequence of the steps S1 to S5 for the second and subsequent times, the reference currents $I_R$, $I_G$ and $I_B$ have been updated in the step S4 of the preceding first sequence or in the preceding step S6. Also, the luminance and chromaticity obtained in the steps S1 to S3 change according to the reference currents $I_R$, $I_G$ and $I_B$. Thus, the measurement results obtained in the steps S1 to S3 of the first sequence executed for the second or subsequent times will be different from those obtained in the steps S1 to S3 of the preceding first sequence. Therefore, in the step S4 of the first sequence executed for the second or subsequent times, the reference currents $I_R$, $I_G$ and $I_B$ will be set at values different from those set in the step S4 of the preceding first sequence of the preceding step S6.

As described above, the luminance and chromaticity of the white-colored image displayed in the step 5 and the power consumption W are made fall within tolerance. All the necessary information is stored in the controller CNT so as to make the actual reference currents $I_R$, $I_G$ and $I_B$ when the display is in service equal to the values set finally in the above-described adjustment of color balance.

In this method, updating the reference currents $I_R$, $I_G$ and $I_B$ in order to make the luminance and chromaticity of the white-colored image fall within tolerance is executed based not on the luminance and chromaticity of the white-colored image but on the luminance and chromaticity of the raster images. Thus, according to the method, the luminance and chromaticity of the white-colored image can be easily set within tolerance as compared with the case where the reference currents $I_R$, $I_G$ and $I_B$ are updated based on the luminance and chromaticity of the white-colored image.

Also, in this method, updating the reference currents $I_R$, $I_G$ and $I_B$ in order to make the power consumption W within tolerance is executed after the luminance and chromaticity of the white-colored image are set within tolerance. When using an algorithm, for example, represented by the equations (15) to (17), the change in the chromaticity of the white-colored image due to the updating is small.

Thus, according to this method, the adjustment of color balance can be completed with in a shorter period of time and be more easily automated as compared with the method in which the reference currents $I_R$, $I_G$ and $I_B$ are updated based on the luminance and chromaticity of the white-colored image.

The adjustment of color balance may be executed before connecting the video signal line driver XDR and the scan signal line driver YDR to the controller CNT. Alternatively, The adjustment of color balance may be executed mounting connecting the video signal line driver XDR and the scan signal line driver YDR onto the display panel DP.

At least one of the repeat count $N_1$ for the first sequence of the steps S1 to S5, the repeat count $N_2$ for the second sequence of the steps S6 and S5, the sum $N_1+N_2$ of the repeat counts may have an upper limit. In this case, for example, when the repeat count or the sum of the repeat counts for an article subjected to the adjustment exceeds the upper limit, the particular article may be treated as an article that does not meet the standards.

The initial values $I_R(0)$, $I_G(0)$ and $I_B(0)$ may be changed based on the reference currents $I_R$, $I_G$ and $I_B$ finally set in each adjustment of color. For example, the reference currents $I_R$, $I_G$ and $I_B$ finally set in each adjustment of color may be recorded and the respective mean values may be utilized as the initial values $I_R(0)$, $I_G(0)$ and $I_B(0)$.

$Y_W(IV)$, $x_W(IV)$ and $y_W(IV)$ of the target white-colored image may be changed based on the luminance and chromaticity of the white-colored image measured at the last in each adjustment of color. For example, the luminance and chromaticity of the white-colored image measured at the last in each adjustment of color may be recorded and $Y_W(IV)$, $x_W(IV)$ and $y_W(IV)$ may be updated based on the respective mean values.

Similarly, the target power consumption W(IV) may be changed based on the power consumption W measured at the last in each adjustment of color. For example, the power consumption W measured at the last in each adjustment of color may be recorded and the target power consumption W(IV) may be updated based on the mean value.

Although the structures shown in FIG. 1 are employed in the pixels PXR, PXG ad PXB in the present embodiment, they may employ other structures. For example, instead of connecting the diode-connecting switch SWc between the drain and gate of the drive control element DR, it may be connected between the gate of the drive control element DR and the video signal line DL. Alternatively, instead of connecting the signal supply control switch SWb between the drain of the drive control element DR and video signal line DL, it may be connected between the gate of the drive control element and the video signal line DL.

Although the structure in which the current signals as the analog video signals are written on the pixels PXR, PXG and PXB is employed, it is possible to employ the structure in which voltage signals as the analog video signals are written on the pixels PXR, PXG and PXB. In this case, instead of using the reference current $I_{ref}$ as the reference value for the magnitude of the analog video signal, a reference voltage $V_{ref}$ is utilized. In this case, the adjustment of color is executed by the same method except that the reference voltage $V_{ref}$ is updated for each emitting color instead of updating the reference current $I_{ref}$ for each emitting color.

Although the organic EL elements are used as the emitting elements, other emitting elements may be used. For example, light-emitting diodes or inorganic EL elements may be used as the emitting elements.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method of manufacturing an active-matrix display comprising first to third pixels each including an emitting element and different in emitting color from one another, and first to third signal output circuits outputting video signals to the first to third pixels, respectively, comprising:

a first step including writing a first adjustment video signal on the first pixel to allow the first pixel emit light and, in this state, measuring luminance and chromaticity as first monochromatic color data;

a second step including writing a second adjustment video signal on the second pixel to allow the second pixel emit light and, in this state, measuring luminance and chromaticity as second monochromatic color data;

a third step including writing a third adjustment video signal on the third pixel to allow the third pixel emit light and, in this state, measuring luminance and chromaticity as third monochromatic color data;

a fourth step including updating the first to third adjustment video signals based on the first to third monochromatic color data such that luminance and chromaticity, of a combination of the first to third pixels when the first to third pixels emit light simultaneously, are predetermined target values when the updated first to third adjustment video signals are written on the first to third pixels, respectively to allow the first to third pixels to emit light simultaneously;

a fifth step including writing the updated first to third adjustment video signal on the first to third pixels, respectively to allow the first to third pixels to emit light simultaneously, and in this state, measuring luminance and chromaticity, of a combination of the first to third pixels when the first to third pixels emit light simultaneously, as mixed color data; and a sixth step including, in a case where the mixed color data is within a predetermined range and power consumption of the display or the first to third pixels at the measurement of the mixed color data exceeds a predetermined upper limit, updating the first to third adjustment video signals such that the power consumption is equal to or lower than the upper limit, and the method including setting the first to third adjustment video signals updated finally as maximum values of the video signals to be written on the first to third pixels, respectively.

2. The method according to claim 1, further including:

in a case where the mixed color data is within the range and the power consumption is equal to or lower than the upper limit, setting the first to third adjustment video signals updated in the fourth step as the maximum values of the video signals to be written on the first to third pixels, respectively;

in a case where the mixed color data is within the range and the power consumption exceeds the upper limit, executing the fifth step again after the sixth step; and in a case where the mixed color data is out of the range, executing the first to fifth steps again.

3. The method according to claim 1, wherein the video signals are current signals.

4. The method according to claim 1, wherein the emitting element is an organic EL element.

5. A method of manufacturing an active-matrix display comprising first to third pixels each including an emitting element and different in emitting color from one another, a first digital-to-analog conversion circuit generating an analog video signal using a first digital video signal and a first reference current or voltage and outputting the analog video signal thus generated to the first pixel, a second digital-to-analog conversion circuit generating an analog video signal using a second digital video signal and a second reference current or voltage and outputting the analog video signal thus generated to the second pixel, a third digital-to-analog conversion circuit generating an analog video signal using a third digital video signal and a third reference current or voltage and outputting the analog video signal thus generated to the third pixel, a first power supply circuit outputting the first reference current or voltage to the first digital-to-analog conversion circuit, a second power supply circuit outputting the second reference current or voltage to the second digital-to-analog conversion circuit, and a third power supply circuit outputting the third reference current or voltage to the third digital-to-analog conversion circuit, comprising:

a first step including writing the analog video signal corresponding to a maximum value of the first digital video signal on the first pixel to allow the first pixel emit light and, in this state, measuring luminance and chromaticity as first monochromatic color data;

a second step including writing the analog video signal corresponding to a maximum value of the second digital video signal on the second pixel to allow the second pixel emit light and, in this state, measuring luminance and chromaticity as second monochromatic color data;

a third step including writing the analog video signal corresponding to a maximum value of the third digital video signal on the third pixel to allow the third pixel emit light and, in this state, measuring luminance and chromaticity as third monochromatic color data;

a fourth step including updating the first to third reference currents or voltages based on the first to third monochromatic color data such that luminance and chromaticity, of a combination of the first to third pixels when the first to third pixels emit light simultaneously, are predetermined target values when the analog video signal corresponding to the maximum value of the first digital video signal, the analog video signal corresponding to the maximum value of the second digital video signal, and the analog video signal corresponding to the maximum value of the third digital video signal are written on the first to third pixels, respectively to allow the first to third pixels to emit light simultaneously;

a fifth step including, after updating the first to third reference currents or voltages, writing the analog video signal corresponding to the maximum value of the first digital video signal, the analog video signal corresponding to the maximum value of the second digital video signal, and the analog video signal corresponding to the maximum value of the third digital video signal are written on the first to third pixels, respectively to allow the first to third pixels to emit light simultaneously, and in this state, measuring luminance and chromaticity, of a combination of the first to third pixels when the first to third pixels emit light simultaneously, as mixed color data; and a sixth step including, in a case where the mixed color data is within a predetermined range and power consumption of the display or the first to third pixels at the measurement of the mixed color data exceeds a predetermined upper limit, updating the first to third reference currents or voltages such that the power consumption is equal to or lower than the upper limit.

6. The method according to claim 5, further including:

in a case where the mixed color data is within the range and the power consumption exceeds the upper limit, executing the fifth step again after the sixth step; and in a case where the mixed color data is out of the range, executing the first to fifth steps again.

7. The method according to claim 5, wherein the video signals are current signals.

8. The method according to claim 5, wherein the emitting element is an organic EL element.

9. A method of adjusting color balance for an active-matrix display comprising first to third pixels each including an emitting element and different in emitting color from one another, and first to third signal output circuits outputting video signals to the first to third pixels, respectively, comprising:

a first step including writing a first adjustment video signal on the first pixel to allow the first pixel emit light and, in this state, measuring luminance and chromaticity as first monochromatic color data;

a second step including writing a second adjustment video signal on the second pixel to allow the second pixel emit light and, in this state, measuring luminance and chromaticity as second monochromatic color data;

a third step including writing a third adjustment video signal on the third pixel to allow the third pixel emit light and, in this state, measuring luminance and chromaticity as third monochromatic color data;

a fourth step including updating the first to third adjustment video signals based on the first to third monochromatic color data such that luminance and chromaticity, of a combination of the first to third pixels when the first to third pixels emit light simultaneously, are predetermined target values when the updated first to third adjustment video signals are written on the first to third pixels, respectively to allow the first to third pixels to emit light simultaneously;

a fifth step including writing the updated first to third adjustment video signal on the first to third pixel, respectively to allow the first to third pixels to emit light simultaneously, and in this state, measuring luminance and chromaticity, of a combination of the first to third pixels when the first to third pixels emit light simultaneously, as mixed color data; and a sixth step including, in a case where the mixed color data is within a predetermined range and power consumption of the display or the first to third pixels at the measurement of the mixed color data exceeds a predetermined upper limit, updating the first to third adjustment video signals such that the power consumption is equal to or lower than the upper limit, and the method including setting the first to third adjustment video signals updated finally as maximum values of the video signals to be written on the first to third pixels, respectively.

10. A method of adjusting color balance for an active-matrix display comprising first to third pixels each including an emitting element and different in emitting color from one another, a first digital-to-analog conversion circuit generating an analog video signal using a first digital video signal and a first reference current or voltage and outputting the analog video signal thus generated to the first pixel, a second digital-to-analog conversion circuit generating an analog video signal using a second digital video signal and a second reference current or voltage and outputting the analog video signal thus generated to the second pixel, a third digital-to-analog conversion circuit generating an analog video signal using a third digital video signal and a third reference current or voltage and outputting the analog video signal thus generated to the third pixel, a first power supply circuit outputting the first reference current or voltage to the first digital-to-analog conversion circuit, a second power supply circuit outputting the second reference current or voltage to the second digital-to-analog conversion circuit, and a third power supply circuit outputting the third reference current or voltage to the third digital-to-analog conversion circuit, comprising:

a first step including writing the analog video signal corresponding to a maximum value of the first digital video signal on the first pixel to allow the first pixel emit light and, in this state, measuring luminance and chromaticity as first monochromatic color data;

a second step including writing the analog video signal corresponding to a maximum value of the second digital video signal on the second pixel to allow the second pixel emit light and, in this state, measuring luminance and chromaticity as second monochromatic color data;

a third step including writing the analog video signal corresponding to a maximum value of the third digital video signal on the third pixel to allow the third pixel emit light and, in this state, measuring luminance and chromaticity as third monochromatic color data;

a fourth step including updating the first to third reference currents or voltages based on the first to third monochromatic color data such that luminance and chromaticity, of a combination of the first to third pixels when the first to third pixels emit light simultaneously, are predetermined target values when the analog video signal corresponding to the maximum value of the first digital video signal, the analog video signal corresponding to the maximum value of the second digital video signal, and the analog video signal corresponding to the maximum value of the third digital video signal are written on the first to third pixels, respectively to allow the first to third pixels to emit light simultaneously;

a fifth step including, after updating the first to third reference currents or voltages, writing the analog video signal corresponding to the maximum value of the first digital video signal, the analog video signal corresponding to the maximum value of the second digital video signal, and the analog video signal corresponding to the maximum value of the third digital video signal are written on the first to third pixels, respectively to allow the first to third pixels to emit light simultaneously, and in this state, measuring luminance and chromaticity, of a combination of the first to third pixels when the first to third pixels emit light simultaneously, as mixed color data; and a sixth step including, in a case where the mixed color data is within a predetermined range and power consumption of the display or the first to third pixels at the measurement of the mixed color data exceeds a predetermined upper limit, updating the first to third reference currents or voltages such that the power consumption is equal to or lower than the upper limit.

* * * * *